US011675297B2

(12) United States Patent
Yasui et al.

(10) Patent No.: US 11,675,297 B2
(45) Date of Patent: Jun. 13, 2023

(54) FUSING APPARATUS

(71) Applicant: CANON KABUSHIKI KAISHA, Tokyo (JP)

(72) Inventors: Tatsuo Yasui, Saitama (JP); Koji Takematsu, Chiba (JP); Keiichi Mizukami, Tokyo (JP); Takuya Hasegawa, Tokyo (JP); Tomoaki Tanto, Chiba (JP); Kazuki Tada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/541,093

(22) Filed: Dec. 2, 2021

(65) Prior Publication Data

US 2022/0179342 A1 Jun. 9, 2022

(30) Foreign Application Priority Data

Dec. 8, 2020 (JP) ..... JP2020-203550
Oct. 11, 2021 (JP) ..... JP2021-166580

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2018/0210377 A1* 7/2018 Hashimoto ..... G03G 15/2017

* cited by examiner

*Primary Examiner* — Thomas S Giampaolo, II
(74) *Attorney, Agent, or Firm* — Canon U.S.A., Inc. I.P. Division

(57) ABSTRACT

A fusing apparatus having a heating rotary member, a pressing rotary member, a flange, a fusing frame, a pressing member, and a plate. The heating rotary member heats a recording medium and includes a heater and a film that rotates. The pressing rotary member rotates to press an outer circumferential surface of the film and performs fusing of a toner image on the recording medium. The flange supports the heater. The fusing frame supports the pressing rotary member and has a positioning hole. The pressing member presses the flange. The plate includes a pressure receiving portion and an insertion portion. The pressure receiving portion is pressed by the pressing member and the insertion portion is inserted into a positioning hole and positioned in a first state. The insertion portion is removed from the positioning hole in a second state where the pressing member further contracts from the first state.

10 Claims, 8 Drawing Sheets

FUSING APPARATUS

BACKGROUND

Field

The present disclosure relates to a fusing apparatus that applies heat and pressure to an unfused toner image to fuse the unfused toner image.

Description of the Related Art

An image forming apparatus includes a fusing apparatus that fuses an unfused toner image on a recording medium.

The fusing apparatus according to the present disclosure includes a heater, a thin film, and a pressing roller. The pressing roller that is rotated is pressed by the heater via the film, so that the film is rotated and a nip portion is formed. An unfused toner image is nipped and conveyed in the nip portion, and heat is applied by the heater via the film. Thus, the unfused toner image is fused on a recording medium.

Japanese Patent Application Laid-Open No. 2003-122147 discusses a configuration relating to a pressing mechanism of a fusing apparatus.

The pressing mechanism that applies pressure to an unfused toner image to fuse the unfused toner image on a recording medium includes a pressing spring.

A flange that restricts a movement of a film in a longitudinal direction is attached to each of both end portions of a heater in a longitudinal direction. The pressing sprig presses the flange in a pressing roller direction to generate a pressing force.

The pressing spring is disposed between the flange and a plate fixed to a fusing frame.

The plate pushes the pressing spring at the time of fusing apparatus assembly. A length of the pushed pressing spring becomes smaller than a normal length of the pressing spring. The plate is fixed to the fusing frame in a state in which the pressing spring contracts. In the fixing of the plate to the fusing frame, screws are used. Because of the configuration where the plate is fixed to the fusing frame in a state in which the pressing spring contracts, a pressing force for forming a nip portion is generated.

Conventionally, screws are used to fix the plate to the fusing frame. Thus, an assembly worker needs to turn the screw while pushing in the plate against a restoring force of the spring, which requires the large number of assembly operations. Consequently, there is a demand for reduction in the number of assembly operations in the process for positioning the plate on the fusing frame.

SUMMARY

The present disclosure is directed to a fusing apparatus capable of reducing the number of assembly operations.

According to an aspect of the present disclosure, a fusing apparatus includes a heating rotary member configured to heat a recording medium, the heating rotary member including a film having an endless form and configured to rotate and a heater configured to generate heat, a pressing rotary member that is rotated and configured to press an outer circumferential surface of the film, wherein, in a state where the pressing rotary member forms a nip portion with the heating rotary member and a recording medium bearing an unfused toner image passes through the nip portion, the pressing rotary member performs fusing and fixing of a toner image on the recording medium with the heating rotary member, a flange configured to restrict a movement of the film in a longitudinal direction of the film and support the heater, a fusing frame configured to support the pressing rotary member, wherein the fusing frame has a positioning hole, a pressing member configured to press the flange, and a plate including a pressure receiving portion and an insertion portion, wherein the pressure receiving portion is pressed by the pressing member and the insertion portion is inserted into the positioning hole, wherein a position of the insertion portion is set by the positioning hole in a first state in which the pressing member contracts, and wherein, in a case where the pressing member is in a second state in which the pressing member further contracts from the first state, the insertion portion is removed from the positioning hole.

Further features of the present disclosure will become apparent from the following description of exemplary embodiments with reference to the attached drawings.

DESCRIPTION OF THE EMBODIMENTS

<Image Forming Apparatus>

Figure 1:
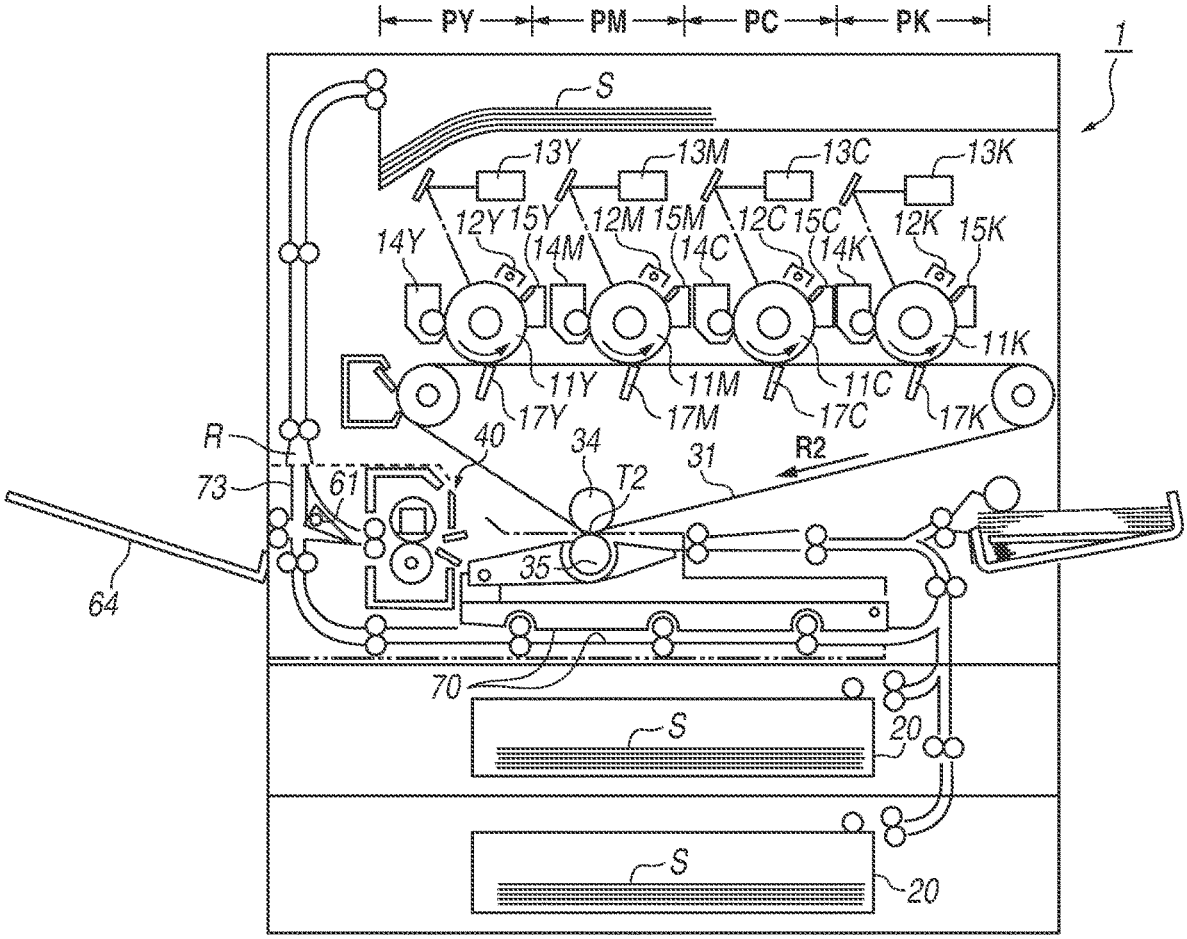
FIG. 1 is a schematic diagram illustrating a cross section of an image forming apparatus.

FIG. 1 is a schematic diagram illustrating a cross section of an image forming apparatus 1. As illustrated in FIG. 1, the image forming apparatus 1 is a full-color printer with a tandem intermediate transfer system in which image forming units PY, PM, PC, and PK for yellow, magenta, cyan, and black, respectively, are arranged along a movement direction of an intermediate transfer belt 31 indicated by an arrow R2.

An image forming process is described using an example of the image forming unit PY.

First, in the image forming unit PY, a charging device 12Y uniformly charges a surface of a photosensitive drum 11Y. After the surface of the photosensitive drum 11Y is uniformly charged, an exposure device 13Y irradiates the photosensitive drum 11Y with laser light based on image data to form an electrostatic latent image on the surface of the photosensitive drum 11Y. Subsequently, a developing device 14Y causes yellow toner to adhere to the photosensitive drum 11Y to form a yellow toner image on the surface of the photosensitive drum 11Y. Then, a voltage is applied to a primary transfer blade 17Y, so that the formed yellow toner image is primarily transferred to the intermediate transfer belt 31. After the primary transfer, a cleaning blade 15Y scrapes and removes residual yellow toner which remains on the photosensitive drum 11Y without being transferred.

Similarly, a series of such processes is performed in each of the image forming units PM, PC, and PK, and thus a full-color toner image is formed on the intermediate transfer belt 31.

The full-color toner image on the intermediate transfer belt 31 is fed to a secondary transfer portion T2 formed by a pair of secondary transfer rollers 34 and 35. The full-color toner image on the intermediate transfer belt 31 is transferred (secondarily transferred) to a recording medium S fed one by one from a recording medium cassette 20. In this process, the full-color toner image on the intermediate transfer belt 31 is not fused on the recording medium S yet. The full-color toner image in such an unfused state is defined as an unfused toner image.

Examples of the recording medium S include plain paper, a resin sheet, coated paper, thick paper, and an overhead projector sheet.

After passing through the secondary transfer portion T2, the recording medium S bearing the unfused toner image is conveyed to a fusing apparatus 40. The fusing apparatus 40 applies heat and pressure to the recording medium S bearing the unfused toner image, and the toner image is fused on the recording medium S. After passing through the fusing apparatus 40, the recording medium S on which the toner image has been fused is discharged to a discharge tray 64.

A description is given of a case where toner images are formed on two sides of the recording medium S. The recording medium S having one side on which the toner image has been fused and fixed by the fusing apparatus 40 is conveyed to a conveyance path 73 by a flapper 61. The recording medium S is switched back and conveyed in the conveyance path 73. The switched-back recording medium S passes a duplex conveyances path 70. In the secondary transfer portion T2, a toner image is secondarily transferred to the other side of the recording medium S. Subsequently, the recording medium S having the other side on which the toner image has been fused and fixed by the fusing apparatus 40 is discharged to the discharge tray 64.

<Fusing Apparatus according to Present Exemplary Embodiment>

Next, the fusing apparatus 40 according to the present exemplary embodiment is described with reference to FIGS. 2, 3, and 4.

Figure 2:
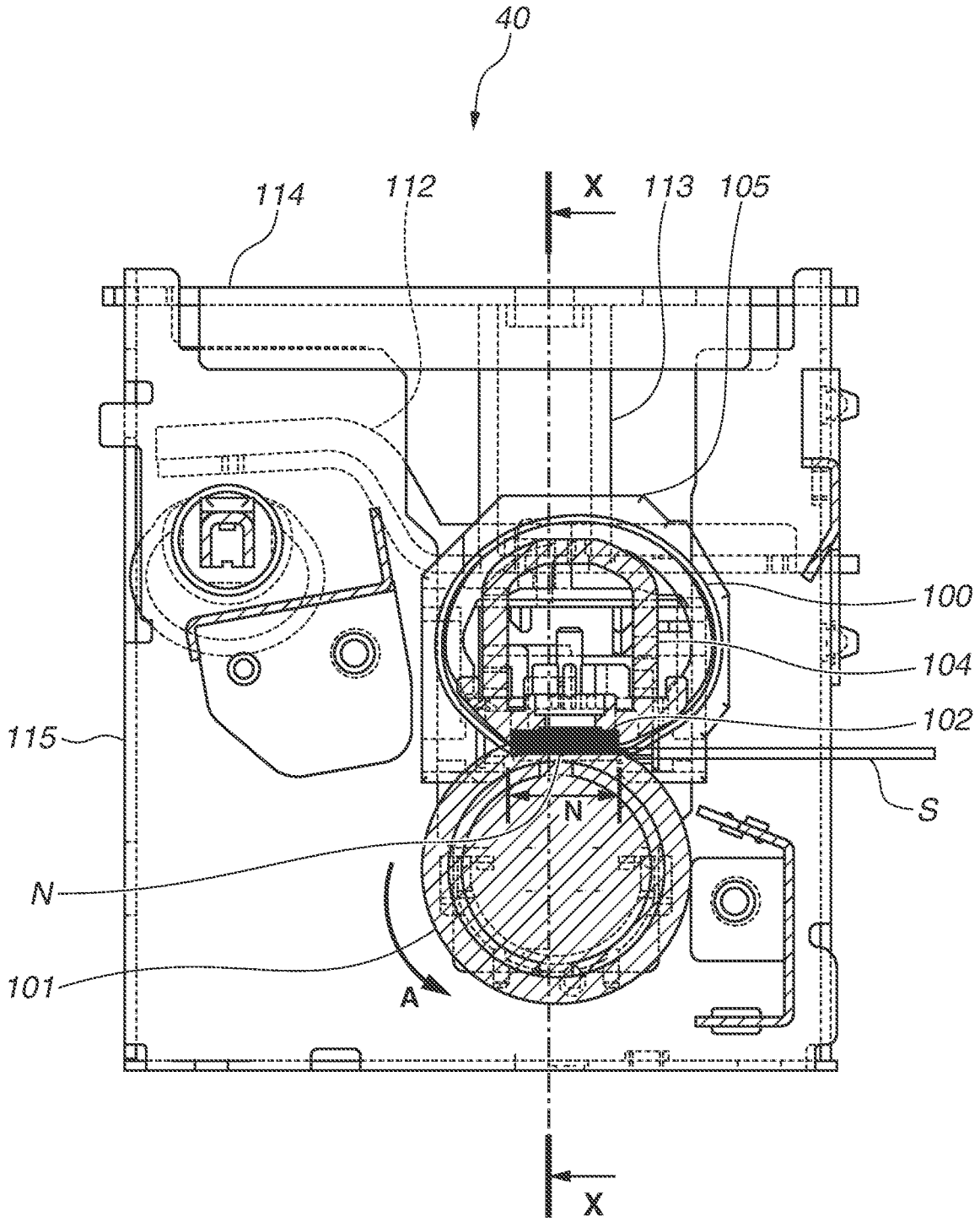
FIG. 2 is a schematic diagram illustrating a cross section of a fusing apparatus.

FIG. 2 is a schematic diagram illustrating a cross section of the fusing apparatus 40. FIG. 3 is a sectional view of the fusing apparatus 40 taken along the line X-X of FIG. 2. FIG. 4 is a perspective view illustrating the fusing apparatus 40.

As illustrated in FIG. 2, the fusing apparatus 40 includes a fusing film 100, a heater 102, and a pressing roller 101.

The fusing film 100 is a rotatable endless film, and the heater 102 is in contact with an inner circumferential surface of the fusing film 100. The heater 102 includes a heat resistor (not illustrated). An electric current flows to the heat resistor, so that the heater 102 generates heat. Heat generated from the heater 102 is transmitted to an outer circumferential surface of the fusing film 100. For the fusing film 100, a thin film having high thermal conductivity is used. Accordingly, the heat from the heater 102 is efficiently transmitted to the outer circumferential surface of the fusing film 100. Thus, an outer circumferential surface temperature of the fusing film 100 can reach a temperature exceeding a toner melting-point temperature in a short time. Accordingly, a duration of time from when a request for printing is issued to when a recording medium is discharged is shortened. In addition, since control for a continuous rise in temperature of the heater 102 is not constantly performed, power saving can be achieved.

The pressing roller 101 comes into contact with the heater 102 via the fusing film 100, so that a nip portion N is formed. The pressing roller 101 is rotated in a direction indicated by an arrow A illustrated in FIG. 2 by a rotation drive motor (not illustrated). Such rotation of the pressing roller 101 rotates the fusing film 100.

The pressing roller 101 includes a cylindrical cored bar made of metal, such as iron and aluminum, and an elastic layer disposed on an outer circumferential surface of the cylindrical cored bar. The elastic layer is made of silicone rubber. A release layer made of perfluoroalkoxy (PFA) resin is disposed on an outer circumferential surface of the elastic layer. The cylindrical cored bar of the pressing roller 101 has a shape extending outward relative to the fusing film 100 in a longitudinal direction of the fusing film 100. Thus, both end portions of the pressing roller 101 protrude outward relative to the fusing film 100 in the longitudinal direction of the fusing film 100.

Figure 4:
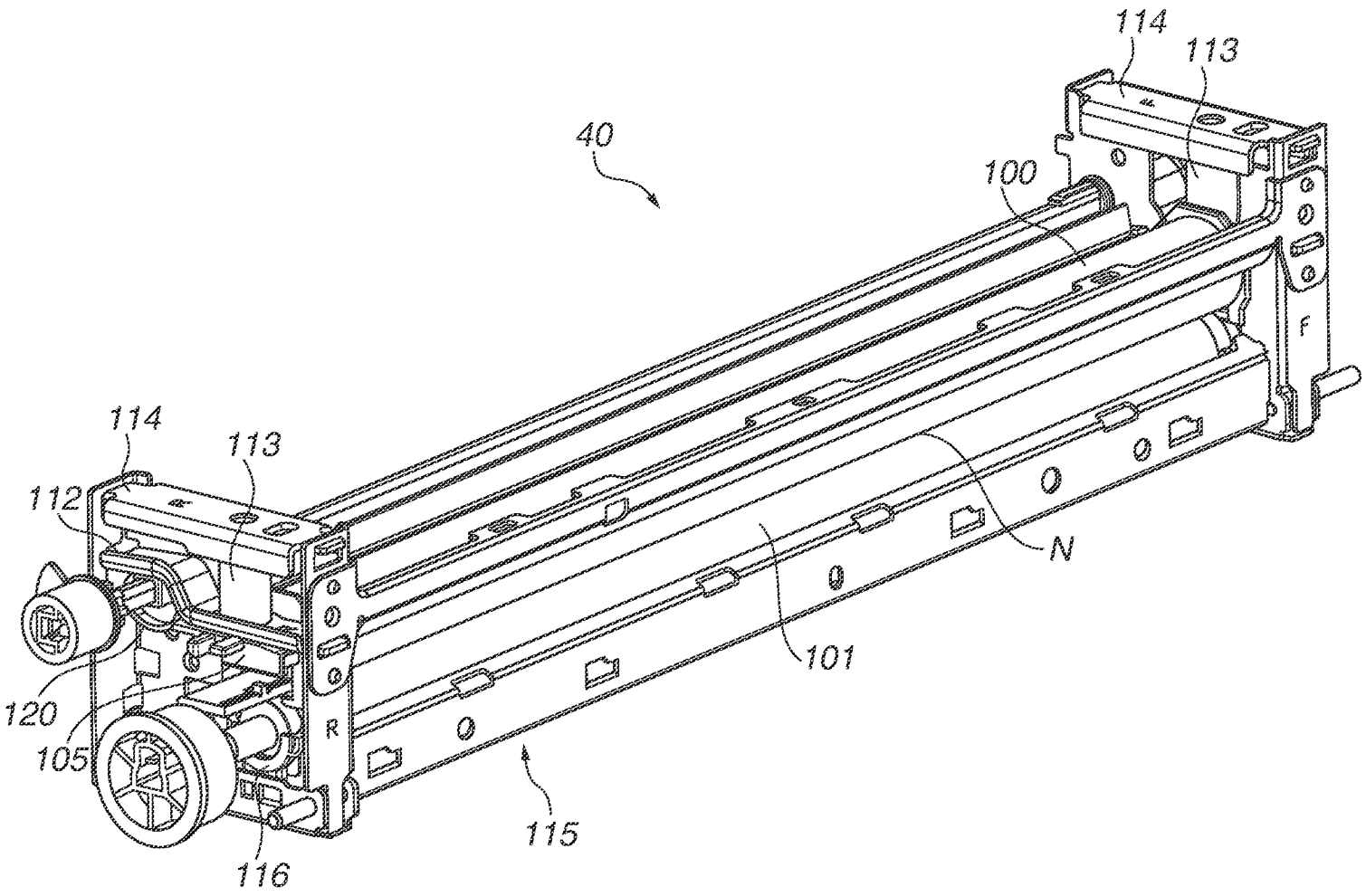
FIG. 4 is a perspective view illustrating the fusing apparatus.

As illustrated in FIG. 4, a bearing member 116 that supports rotation of the pressing roller 101 is disposed in a protruding portion of the cylindrical cored bar. The bearing member 116 is supported by a fusing frame 115. Thus, the fusing apparatus 40 according to the present exemplary embodiment has a configuration in which both end portions of the pressing roller 101 are supported by the fusing frame 115.

When a recording medium S is conveyed to the nip portion N, heat and pressure are applied to the recording medium S. Then, rotation of the pressing roller 101 causes the recording medium S to be nipped and conveyed by the pressing roller 101 and the fusing film 100, and a toner image is fused on the recording medium S.

<Pressing Mechanism of Fusing Apparatus>

A pressing mechanism 130 of the fusing apparatus 40 is described with reference to FIGS. 2 and 3.

A recording medium S is nipped and conveyed by the pressing roller 101 and the fusing film 100. A certain pressure or more is used to fuse and fix an unfused toner image on the recording medium S.

The heater 102 is supported by a supporting member 103 that supports the heater 102. The supporting member 103 has a shape extending outward relative to the fusing film 100 in a longitudinal direction of the fusing film 100, and is disposed on an inner side of the fusing film 100. The supporting member 103 has a groove into which the heater 102 is fitted at the side of the nip portion N. A stay 104 made of metal is in contact with the supporting member 103. The stay 104 has a U-shape extending in the longitudinal direction of the fusing film 100.

Figure 3:
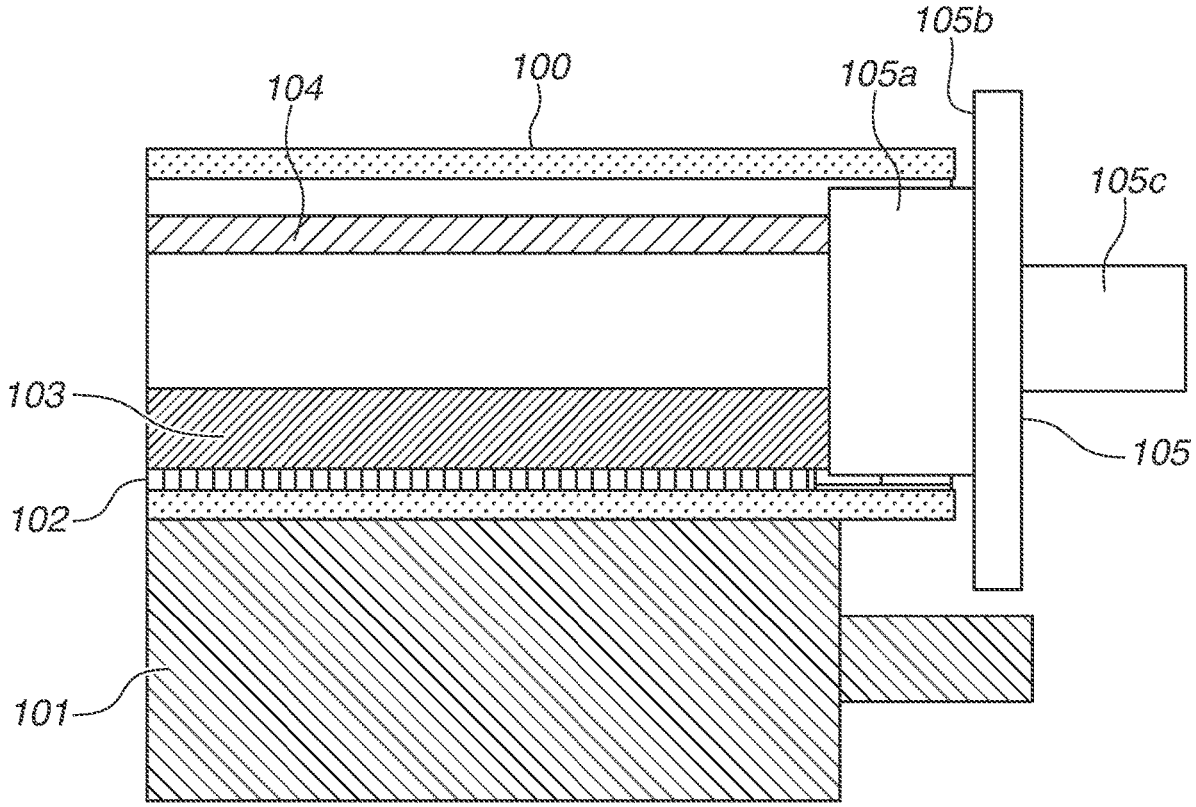
FIG. 3 is a sectional view illustrating the fusing apparatus taken along the line X-X of FIG. 2.

A flange 105 illustrated in FIG. 3 includes a fitting portion 105*a*, a restricting portion 105*b*, and a pressure receiving portion 105*c*. In the both ends of the supporting member 103 and the stay 104, the fitting portion 105*a* nips an end of the supporting member 103 and is fitted into an end of the stay 104. The restricting portion 105*b* restricts a movement of the fusing film 100 in the longitudinal direction of the fusing film 100. If the pressure receiving portion 105*c* is pressed, the flange 105 fitted into each of the both ends of the stay 104 causes the stay 104 to press the supporting member 103, and the heater 102 supported by the supporting member 103 presses the pressing roller 101 via the fusing film 100.

The pressing roller 101 to be pressed is supported by the fusing frame 115 made of metal.

Accordingly, the nip portion N is formed, and a pressure for fusing an unfused toner image on a recording medium S is generated.

The pressing mechanism 130 by which the pressure receiving portion 105*c* of the flange 105 is pressed is described with reference to FIGS. 5A and 5B.

The pressing mechanism 130 includes a pressing spring 113 as a pressing member that generates a pressing force for forming a nip portion N. One end of the pressing spring 113 comes into contact with a pressure receiving portion 114*a* of a plate 114, and the other end of the pressing spring 113 is in contact with a pressing lever 112. The pressing spring 113 uses its restoring force of restoring to a normal length, to press the pressing lever 112.

In a state in which the fusing apparatus 40 is assembled, the pressing spring 113 is in a contracting state (a first state) in which a length of the pressing spring 113 is shorter than its normal length. Thus, the pressing spring 113 has a restoring force acting to restore the pressing spring 113 to the normal length from the first state. With such a restoring force, the pressing spring 113 presses the pressing lever 112. Since the pressing lever 112 is in contact with the pressure receiving portion 105*c* of the flange 105, the pressing spring 113 presses the flange 105 via the pressing lever 112. Thus, a pressing force for pressing a recording medium S is generated.

Figure 5A:
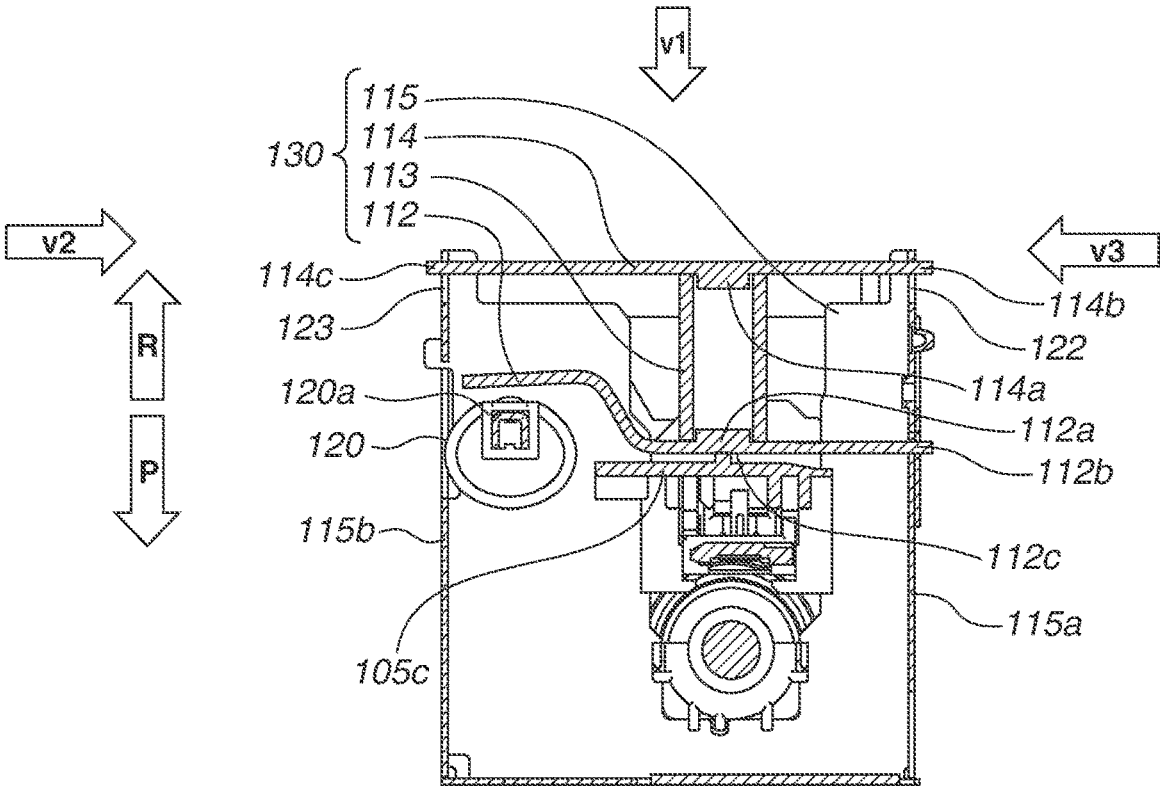
FIG. 5A is a schematic diagram illustrating a cross section of a pressing mechanism in a pressing state.
Figure 5B:
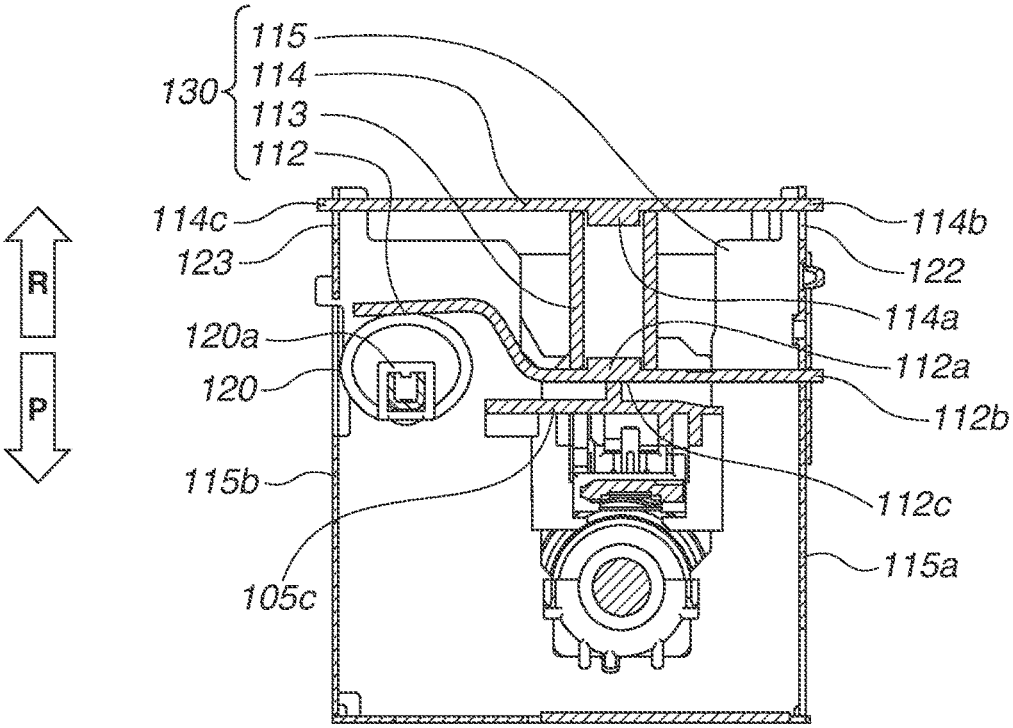
FIG. 5B is a schematic diagram illustrating a cross section of the pressing mechanism in a pressing release state.

On a sheet surface as illustrated in each of FIGS. 5A and 5B, a direction in which the pressing spring 113 presses the flange 105 is defined as a pressing direction P. A direction opposite the pressing direction P is defined as a repulsive direction R.

A switching between a pressing state illustrated in FIG. 5A and a pressing release state illustrated in FIG. 5B is described with reference to FIGS. 5A and 5B.

The pressing lever 112 is rotatable about a support shaft 112*b* as a fulcrum. The pressing lever 112 is pressed by the pressing spring 113, and presses the pressure receiving portion 105*c* of the flange 105.

An eccentric cam 120 is connected to a motor. The motor rotates the eccentric cam 120. Upon receipt of driving from the motor, the eccentric cam 120 rotates by 180 degrees about a drive shaft 120*a*. Accordingly, the eccentric cam 120 pushes up the pressing lever 112, as illustrated in FIG. 5B. Thus, a state in which the pressing lever 112 does not press the pressure receiving portion 105*c* of the flange 105 is set, and the pressing mechanism 130 switches to the pressing release state (FIG. 5B).

After the motor (not illustrated) rotates the eccentric cam 120 by 180 degrees in the pressing release state, the eccentric cam 120 and the pressing lever 112 become a state not in contact with each other. Accordingly, the pressing lever 112 pressed by the pressing spring 113 presses the pressure receiving portion 105*c*. Thus, the pressing mechanism 130 switches to a pressing state (FIG. 5A) in which a nip portion N is formed.

<Positioning of Plate on Fusing Frame>

Conventionally, screws are used to fix a plate to a fusing frame. In the fixing, the screw is turned while a pressing spring is held in a contracting state. Consequently, the increased number of operations at the time of assembly of a fusing apparatus is required. Accordingly, there arises an issue that demand for not using screws in fixing the plate to the fusing frame grows.

The present disclosure is directed to a configuration by which a position of the plate 114 is set on the fusing frame 115 without a screw. Hereinafter, such a configuration is described in detail.

<Shape of Fusing Frame>

As illustrated in FIG. 4, the fusing frame 115 has a groove into which the restricting portion 105*b* of the flange 105 is fitted, and the fusing frame 115 restricts a movement of the flange 105 in a widthwise direction of the fusing film 100.

As illustrated in FIG. 5A, the fusing frame 115 includes two side plates 115*a* and 115*b*. Each of the side plates 115*a* and 115*b* is positioned outside relative to the fusing film 100 in the longitudinal direction of the fusing film 100. In the widthwise direction of the fusing film 100, the side plates 115*a* and 115*b* are disposed opposite each other. The side plates 115*a* and 115*b* are made of metal such as iron, and have good durability. The flange 105 and the pressing spring 113 are disposed inside the side plates 115*a* and 115*b*.

In the repulsive direction R, positioning holes 122 and 123 into which the plate 114 is inserted are formed on end portions of the side plates 115*a* and 115*b*, respectively.

<Shape of Positioning Hole Formed on Fusing Frame>

Figure 6A:
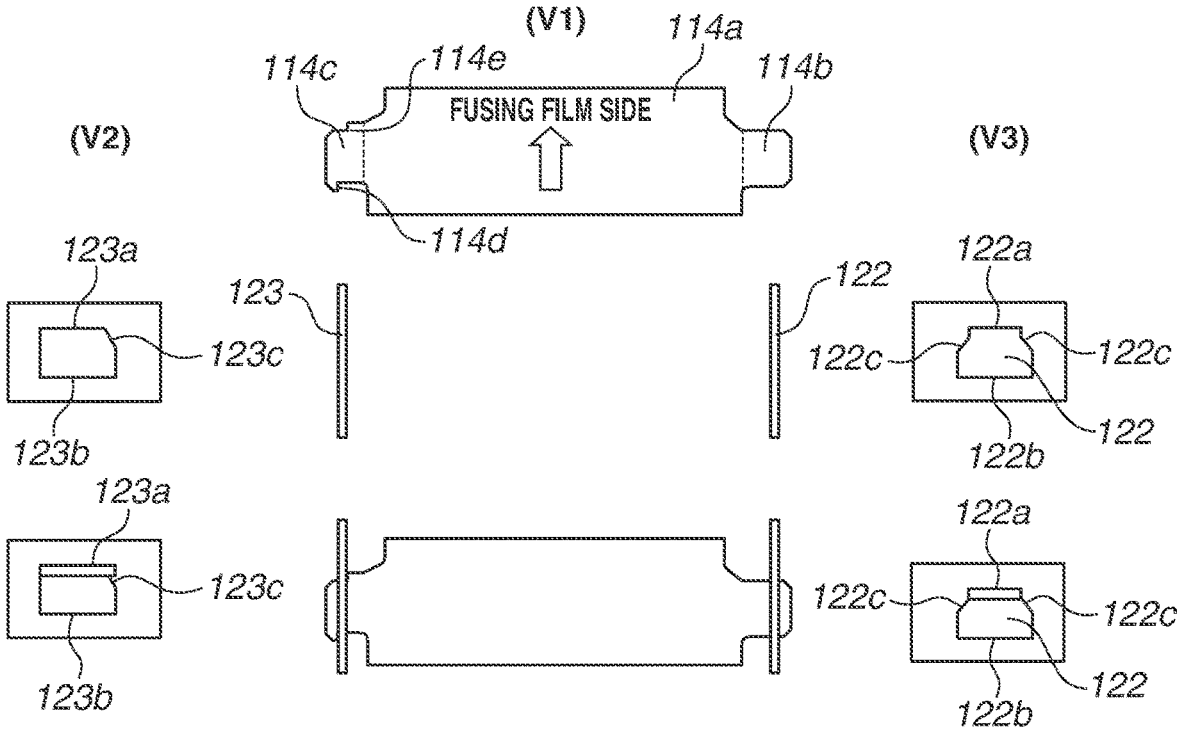
FIG. 6A is a schematic diagram illustrating a plate and a fusing frame as seen from angles v1, v2, and v3.

A shape of a positioning hole formed on the fusing frame 115 according to the present exemplary embodiment is described with reference to FIG. 6*a*. Each of the positioning holes 122 and 123 has a first side, a second side, and an oblique side. The first side is shorter than the second side. The positioning hole 122 has a first side 122*a* and a second side 122*b*. The positioning hole 123 has a first side 123*a* and a second side 123*b*. A view V1 in FIG. 6A illustrates the fusing apparatus 40 as seen from the top when the plate 114 is defined as a top surface. A view V2 in FIG. 6A illustrates the positioning hole 123 as seen from a direction indicated by an arrow v2 illustrated in FIG. 7A. A view V3 in FIG. 6A illustrates a view of the positioning hole 122 as seen from a direction indicated by an arrow v3 illustrated in FIG. 7A.

The first side is a side in a repulsive direction R, and the second side is a side in a pressing direction P.

Each of oblique sides 122*c* and 123*c* connects a first side to a second side.

The positioning hole 122 has two oblique sides 122*c*. However, the number of oblique sides is not limited to two. The positioning hole 122 may have one oblique side as similar to the positioning hole 123.

A shape of the positioning hole 122 is described. As illustrated in the view V3 in FIG. 6A, the first side 122*a* is arranged at an upstream side in the pressing direction P, whereas the second side 122*b* is arranged at a downstream side in the pressing direction P. The positioning hole 122 has the oblique sides 122*c*.

A shape of the positioning hole 123 is described. As illustrated in the view V2 in FIG. 6A, the first side 123*a* is arranged at the upstream side in the pressing direction P, whereas the second side 123*b* is arranged at the downstream side in the pressing direction P. The positioning hole 123 has an oblique side 123*c*.

<Shape of Plate>

Figure 6B:
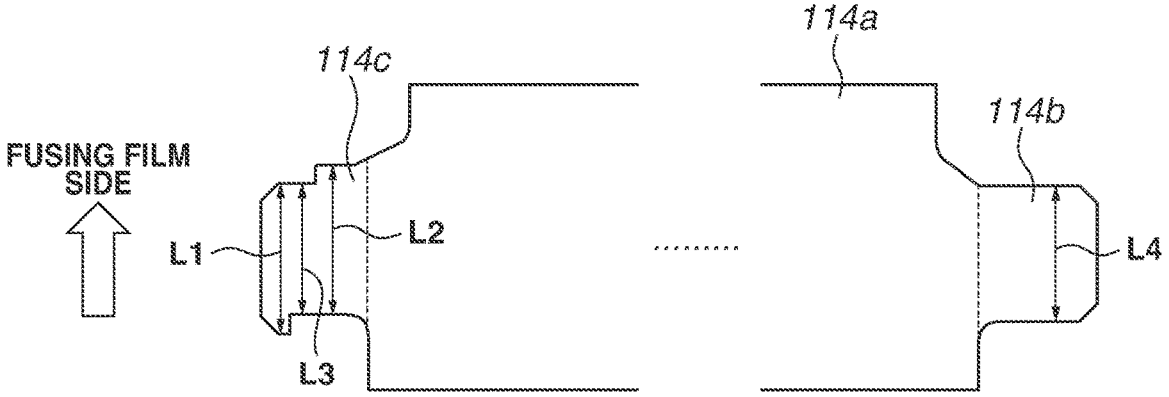
FIG. 6B is an enlarged view illustrating both end portions of the plate as seen from the viewpoint v1.

A shape of the plate 114 according to the present exemplary embodiment is described with reference to FIGS. 6A and 6B.

The plate 114 includes the pressure receiving portion 114*a* which receives a restoring force of the pressing spring 113, and a first insertion portion 114*b* and a second insertion portion 114*c* that are inserted into the positioning holes 122 and 123, respectively.

Each of the first insertion portion 114*b* and the second insertion portion 114*c* is formed to be shorter than the pressure receiving portion 114*a* in the longitudinal direction of the fusing film 100. The pressure receiving portion 114*a* is wider than the first insertion portion 114*b* in the longitudinal direction, so that an area in which the pressing spring 113 as a pressing member presses the pressure receiving portion 114*a* can be made larger. Thus, the pressure receiving portion 114*a* can stably receive a pressing force from the pressing spring 113.

The second insertion portion 114*c* includes a first restriction portion 114*d* and a second restriction portion 114*e* that restrict a movement of the plate 114 in the widthwise direction of the fusing film 100. With these restriction portions, the second insertion portion 114*c* has three widths in the longitudinal direction of the fusing film 100. The first width is a width L1 including a width of the first restriction portion 114*d*. The second width is a width L2 including a width of the second restriction portion 114*e*. The third width is a width L3 excluding a width of the first restriction portion 114*d* and a width of the second restriction portion 114*e*.

The width L1 is longer than the first side 123*a* and shorter than the second side 123*b*. The width L2 is longer than the first side 123*a*.

The width L3 is shorter than the first side 123*a* or the same as a width of the first side 123*a*. However, if the width L3 and a width of the first side 123*a* are the same, the second insertion portion 114*c* and the side plate 115*b* may interfere with each other, which may cause the second insertion portion 114*c* to not come into contact with the first side 123*a*. Accordingly, it is desirable that the width L3 is shorter than the first side 123*a*.

In the longitudinal direction of the fusing film 100, a width L4 of the first insertion portion 114*b* is shorter than the first side 122*a* or the same as a width of the first side 122*a*. However, if the width L4 and a width of the first side 122*a* are the same, the first insertion portion 114*b* and the side plate 115*a* may interfere with each other. Thus, it is desirable that the width L4 is shorter than the first side 122*a*.

<Plate Positioning Method>

A method by which a position of the plate 114 is set on the fusing frame 115 is described with reference to FIGS. 7A, 7B, and 7C.

Figure 7A:
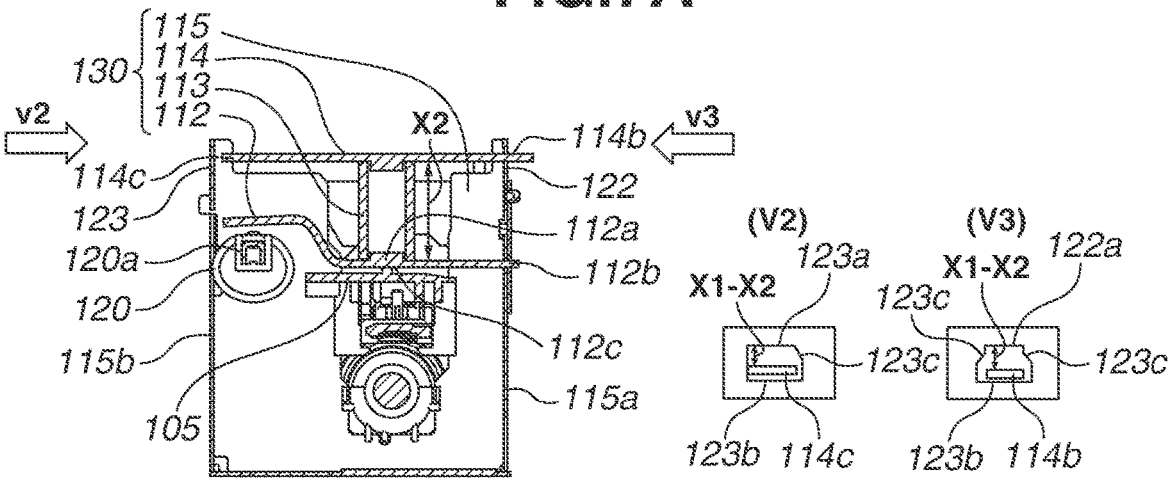
FIG. 7A is a schematic diagram illustrating the pressing mechanism in a state where a first insertion portion is inserted into a positioning hole.

As illustrated in FIG. 7A, the plate 114 is pushed toward the pressing direction P, so that the pressing spring 113 is pressed in the pressing direction P. The pressing spring 113 pressed in the pressing direction P is held at a length X2 that is shorter than its normal length. The first insertion portion 114*b* is inserted into the positioning hole 122 in a state in which the pressing spring 113 is held at the length X2 (a second state).

Figure 7B:
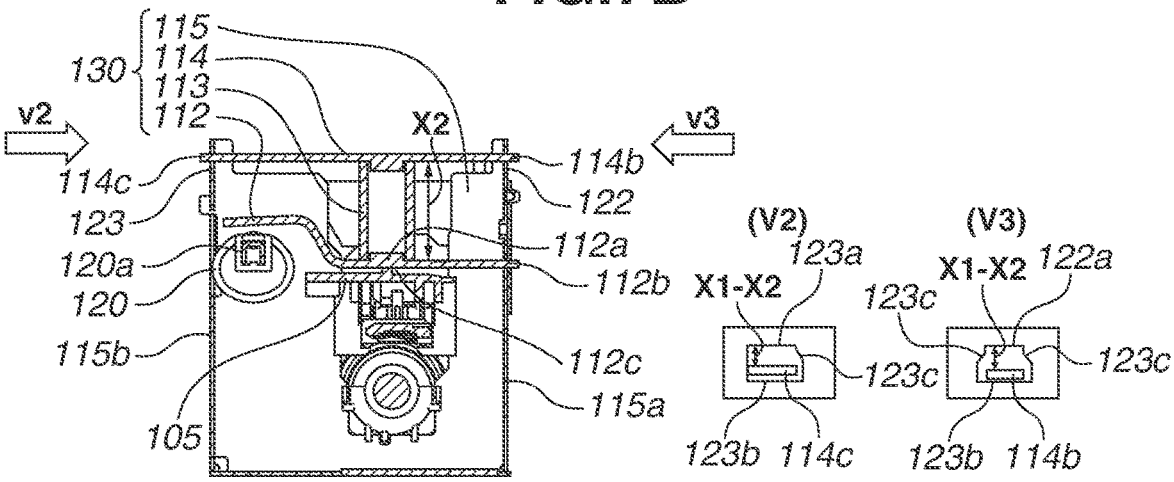
FIG. 7B is a schematic diagram illustrating the pressing mechanism in a state where the first insertion portion and a second insertion portion are inserted into positioning holes.
Figure 7C:
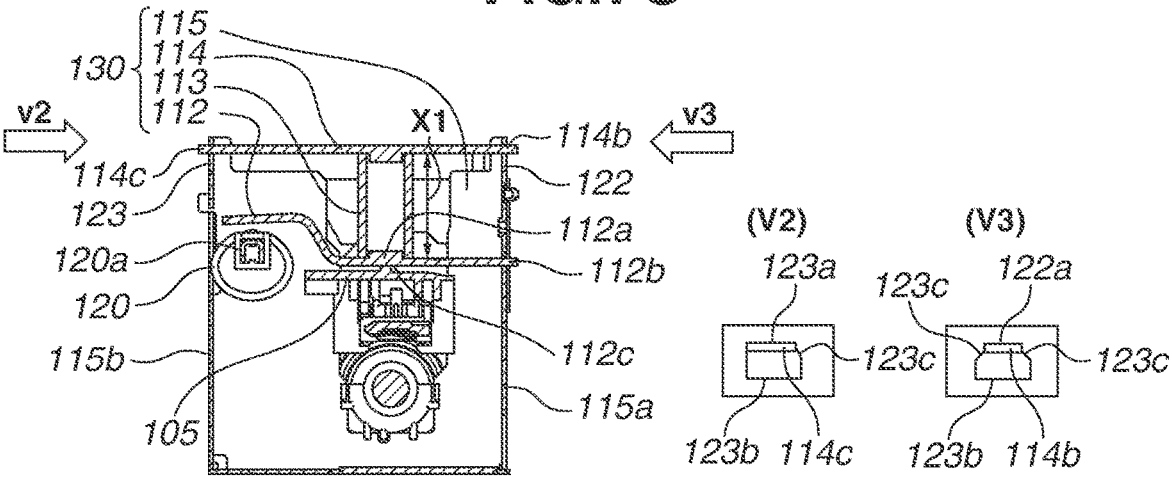
FIG. 7C is a schematic diagram illustrating the pressing mechanism in a state where a position of the plate is set on the fusing frame.

Subsequently, as illustrated in FIG. 7B, the second insertion portion 114*c* is inserted into the positioning hole 123. In this process, the second insertion portion 114*c* is inserted such that a portion having the width L3 is arranged inside the positioning hole 123.

Then, the force for pressing the plate 114 toward the pressing direction P is released, and the plate 114 is moved in the repulsive direction R by a restoring force of the pressing spring 113. In this process, the first insertion portion 114*b* comes into contact with the first side 122*a*. Thus, a movement of the plate 114 in the pressing direction P or the repulsive direction R is restricted. A length of the pressing spring 113 herein becomes a length X1 (the first state) from the length X2 (the second state). The length X1 is shorter than the normal length of the pressing spring 113 and is longer than the length X2. The pressing spring 113 having the length X1 has a restoring force of restoring to the normal length. Such a restoring force is substantially equal to a force that presses the flange 105 to form the nip portion N.

Since both end portions of the plate 114 are inserted into the positioning holes 122 and 123, a movable range of the plate 114 in the longitudinal direction of the fusing film 100 is equivalent to a width of the first sides 122*a* and 123*a*.

A description is given of a case where the first insertion portion 114*b* and second insertion portion 114*c* come into contact with oblique sides in a state where the first insertion portion 114*b* and second insertion portion 114*c* are inserted into the positioning holes 122 and 123, respectively. In a state where the second insertion portion 114*c* comes into contact with the oblique side 123*c*, the second insertion portion 114*c* is guided to the first side 123*a* along the oblique side 123*c*. Similarly, in a state where the first insertion portion 114*b* comes into contact with the oblique side 122*c*, the first insertion portion 114*b* is guided to the first side 122*a* along the oblique side 122*c*. The first insertion portion 114*b* is guided to the first side 122*a* from upstream to downstream in the repulsive direction R along the oblique side 122*c*. Thus, a position of the plate 114 is easily set on the fusing frame 115.

In the present exemplary embodiment in which the pressing roller 101 as a pressing rotary member is disposed between the side plates 115*a* and 115*b*, surfaces of the side plates 115*a* and 115*b* facing the pressing roller 101 are defined as inner surfaces. In a state where a position of the plate 114 is set on the fusing frame 115, the first insertion portion 114*b* and the second insertion portion 114*c* are inserted toward the outer surfaces from the inner surfaces of the side plates 115*a* and 115*b*, respectively, and a part of the first insertion portion 114*b* and a part of the second insertion portion 114*c* protrude from the side plates 115*a* and 115*b*, respectively. However, the configuration is not limited to a case where a part of the first insertion portion 114*b* and a part of the second insertion portion 114*c* protrude from the side plates 115*a* and 115*b*, respectively. The first insertion portion 114*b* and a part of the second insertion portion 114*c* can remain inside the positioning holes 122 and 123.

A description is given based on the premise that a position of the plate 114 has been set on the fusing frame 115. The width L1 illustrated in FIG. 6B is longer than the first side 123*a*, and the width L2 is longer than the first side 123*a*. Accordingly, the first restriction portion 114*d* and the second restriction portion 114*e* nip the side plate 115*b*. Such a state restricts a movement of the plate 114 in the widthwise direction of the fusing film 100.

A description is given of removal of the plate 114 from the fusing frame 115. In a state where positions of the first insertion portion 114*b* and the second insertion portion 114*c* of the plate 114 have been set by the positioning holes 122 and 123, respectively, the pressing spring 113 is in the first state. The pressing spring 113 is pressed in a direction indicated by an arrow P until the pressing spring 113 enters the second state. Then, the first insertion portion 114*b* and the second insertion portion 114*c* come into contact with the second sides 122*b* and 123*b*, respectively. Subsequently, any one of the first insertion portion 114*b* and the second insertion portion 114*c* is removed from the positioning hole. The removed one of the first insertion portion 114*b* and the second insertion portion 114*c* moves in a direction indicated by an arrow R, so that the plate 114 can be removed from the fusing frame 115.

Modification 1

Figure 8:
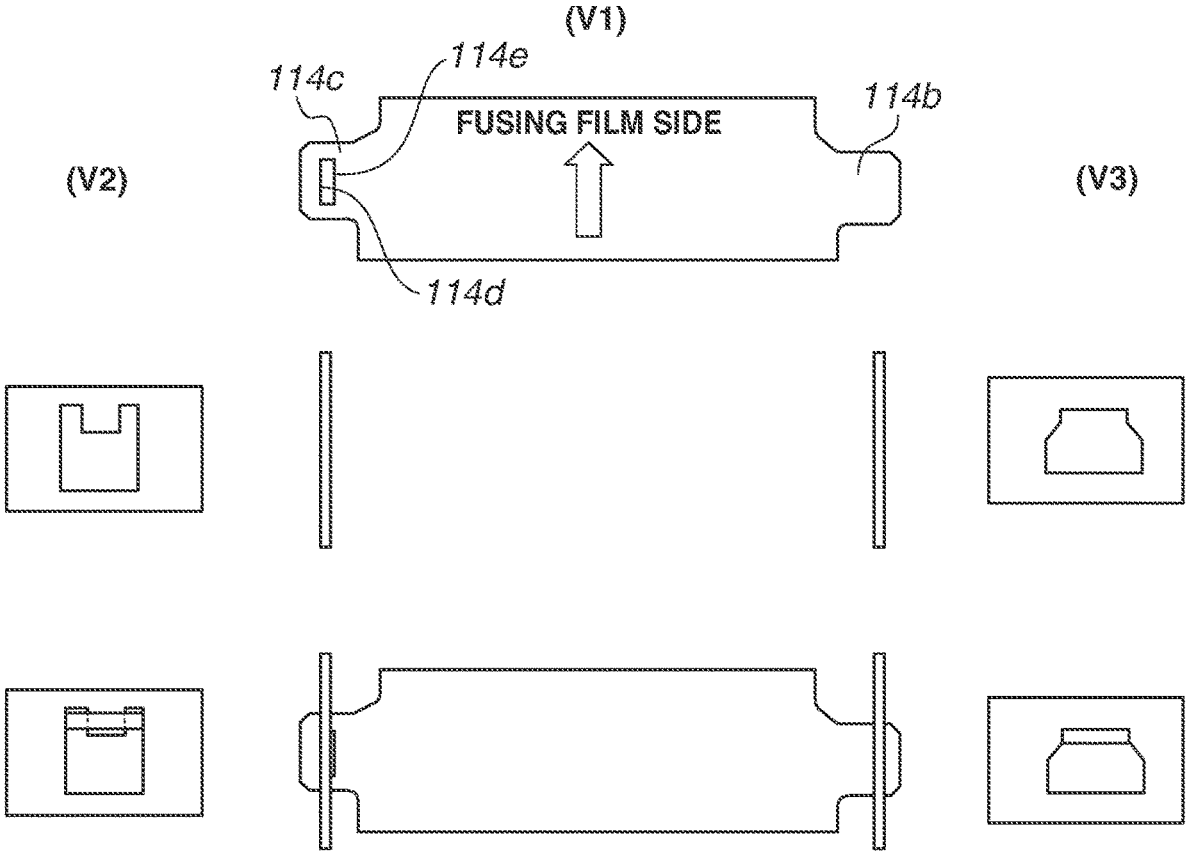
FIG. 8 is a diagram illustrating a modification of the present disclosure.

The present disclosure may be applied to a modification as illustrated in FIG. 8. In the modification illustrated in FIG.

8, a second insertion portion 114*c* has an insertion hole that is longer than a length of a side plate 115*b* in a plate thickness direction. Among sides forming insertion holes, the outer side in a widthwise direction of a fusing film corresponds to the first restriction portion 114*d* of the above-described exemplary embodiment. The inner side in the widthwise direction of the fusing film corresponds to the second restriction portion 114*e* of the above-described exemplary embodiment.

The modification can provide an effect substantially the same as that provided by the above-described exemplary embodiment in terms of positioning of the plate 114 on the fusing frame 115 without a screw.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2020-203550, filed Dec. 8, 2020, and No. 2021-166580, filed Oct. 11, 2021, which are hereby incorporated by reference herein in their entirety.

What is claimed is:

1. A fusing apparatus comprising:

a first rotary member configured to heat a recording medium;

a second rotary member configured to be rotated and to press the first rotary member, wherein, in a state where the second rotary member forms a nip portion with the first rotary member and the recording medium, bearing an unfused toner image, passes through the nip portion, the second rotary member, together with the first rotary member, fuses the toner image on the recording medium;

a fusing frame configured to support the second rotary member, wherein the fusing frame has a first positioning hole and a second positioning hole;

a plate having a pressure receiving portion, a first insertion portion, and a second insertion portion; and a pressing member, wherein one end of the pressing member is in contact with a pressing lever, and an other end of the pressing member is in contact with the pressure receiving portion, wherein the first rotary member presses the second rotary member toward the second rotary member due to the pressing member pressing the pressing lever, wherein, in a direction in which the recording medium is conveyed, the first positioning hole is provided upstream of the pressing member, and the second positioning hole is provided downstream of the pressing member, and wherein the plate is configured such that, in a state in which the pressing member is compressed between the pressing lever and the plate, the first insertion portion is in engagement with the first positioning hole, and the second insertion portion is in engagement with the second positioning hole.

2. The fusing apparatus according to claim 1, wherein, in a longitudinal direction of the first rotary member, the first positioning hole has a first side, a second side longer than the first side, and an oblique side connecting the first side to the second side.

3. The fusing apparatus according to claim 2, wherein in the longitudinal direction, the first insertion portion has a width that is less than or equal to a length of the first side of the first positioning hole.

4. The fusing apparatus according to claim 3, wherein the first insertion portion has a width that is longer than the first side and shorter than the second side.

5. The fusing apparatus according to claim 1, wherein the pressing member is a pressing spring having elasticity.

6. The fusing apparatus according to claim 1, wherein, in a longitudinal direction of the first rotary member, the pressure receiving portion is larger than the first insertion portion and the second insertion portion.

7. The fusing apparatus according to claim 1, wherein the pressing member is in a first state when the first insertion portion is in engagement with the first positioning hole, and the second insertion portion is in engagement with the second positioning hole, and wherein the pressing member is in a second state in which the pressing member further contracts from the first state when the first insertion portion is disengaged from the first positioning hole, and the second insertion portion is disengaged from the second positioning hole.

8. The fusing apparatus according to claim 7, wherein, in a case where one side end portion of the plate moves in a direction in which the pressing member comes into contact with the pressure receiving portion in a state in which the pressing member is in the second state, the plate is removed from the fusing frame.

9. The fusing apparatus according to claim 1, further comprising a flange configured to restrict a movement of the first rotary member in a longitudinal direction of the first rotary member, wherein the pressing lever is configured to press the first rotary member toward the second rotary member via the flange.

10. The fusing apparatus according to claim 9, wherein the fusing frame has a third positioning hole, and wherein the pressing lever is positioned by being in engagement with the third positioning hole.

* * * * *